United States Patent [19]

Oono et al.

[11] Patent Number: 4,475,490

[45] Date of Patent: Oct. 9, 1984

[54] HYDRAULIC VALVE LIFTER

[75] Inventors: Katsuyasu Oono, Toyota; Gozo Kaji, Aichi, both of Japan

[73] Assignee: Toyota Jidosha Kogyo Kabushiki Kaisha, Toyota, Japan

[21] Appl. No.: 383,300

[22] Filed: May 28, 1982

[30] Foreign Application Priority Data

Jan. 19, 1982 [JP] Japan ..... 57-5336

[51] Int. Cl.[3] ..... F01L 1/14

[52] U.S. Cl. ..... 123/90.52; 123/90.48; 123/90.56; 123/90.57; 29/156.7 B

[58] Field of Search ..... 123/90.48, 90.52, 90.53, 123/90.56, 90.57; 29/156.7 R, 156.7 A, 156.7 B, 156.7 C

[56] References Cited

U.S. PATENT DOCUMENTS

| | | | |
|---|---|---|---|
| 2,175,465 | 10/1939 | Johnson | 123/90.56 |
| 2,541,953 | 2/1951 | Banker | 123/90.56 |
| 2,925,074 | 2/1960 | Dadd | 123/90 |
| 2,939,442 | 6/1960 | Dornbos et al. | 123/90 |
| 3,149,410 | 9/1964 | Dornbos | 29/156.7 |
| 3,967,602 | 7/1976 | Brown | 123/90.56 |
| 4,273,983 | 6/1981 | Ogawa et al. | 219/93 |

FOREIGN PATENT DOCUMENTS

| | | | |
|---|---|---|---|
| 716449 | 10/1954 | United Kingdom | 123/90.57 |

*Primary Examiner*—Craig R. Feinberg
*Assistant Examiner*—David A. Okonsky
*Attorney, Agent, or Firm*—Kenyon & Kenyon

[57] ABSTRACT

The present invention proposes a hydraulic valve lifter used in an internal combustion engine. The valve lifter has a body consisting of a hollow cylindrical portion accommodating a cylindrical plunger and a lower end portion engaging with a cam controlling the valve motion. The two portions are joined together by welding. The bottom of the plunger is cut out annularly for preventing interference between the plunger and flash, which flash is caused by welding and remains in the inner recess of the lifter body.

5 Claims, 5 Drawing Figures

HYDRAULIC VALVE LIFTER

The present invention relates to a hydraulic valve lifter for valve trains in an internal combustion engine.

Hydraulic valve lifters are used in many engines. They are very quiet because the zero tappet clearance is assured, and variations due to temperature changes or to wear are taken care of hydraulically.

An end surface of the valve lifter body slidably engages with a cam which is rotatably connected to a crank shaft; therefore, it is necessary that the end portion contacting the cam be highly durable and wear resistant. A conventional valve lifter body is comprised of a unit constructed of an end portion and a hollow cylindrical portion accommodating a plunger, said unit being formed by casting or joined together by brazing. However, it is desirable to obtain a valve lifter having a high quality and a low production cost whereby each of the above two portions is made separately of a different material and then the two portions are joined by projection welding or resistance welding. However, it is difficult to remove flash resulting from welding, especially flash projecting in the inner recess of the body. If the projecting flash is not removed, the plunger may stick when lowered.

SUMMARY OF THE INVENTION

It is an object of the present invention to solve the above problems and to provide a hydraulic valve lifter having a high quality and a low production cost.

Briefly, the invention is directed to above object is attained by a hydraulic valve lifter having a body which consists of a hollow cylindrical portion into which a cylindrical plunger is accommodated slidably along an inner surface of the cylindrical hollow portion in the longitudinal direction and a lower end portion which closes the hole and has an outer adapted for contacting a cam for controlling the valve motion. The improvement comprises having the cylindrical portion and the end portion joined together by means of welding with a section of the outer wall of the cylindrical plunger being cut out annularly at its lowermost area.

With the above arrangement, the lifter body can be constructed in two portions made of different materials joined together by welding. As a section of the plunger is cut out at its outer annular wall which wall, if not cut out, would interfere with any resultant flash which remains unremoved in the inner recess of the body, the risk of sticking is solved without reducing the fundamental function of the hydraulic valve lifter.

The invention will now be described in more detail with reference to the accompanying drawings which illustrate the preferred embodiments of the invention, in which.

DESCRIPTION OF PREFERRED EMBODIMENTS

Figure 1:
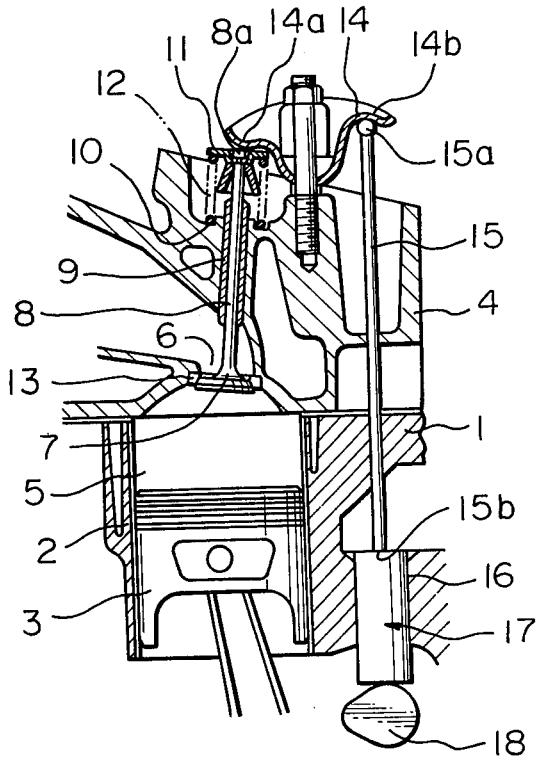
FIG. 1 shows a schematic section of valve trains in which a hydraulic valve lifter is arranged.

In FIG. 1, there is shown a valve train in which a valve lifter is arranged. The numeral 1 represents a cylinder block in which a cylinder 2 is provided. A piston 3 moves reciprocally in the cylinder 2. A cylinder head 4 is disposed on the cylinder block 1, and a combustion chamber 5 is formed between the cylinder 2 and the cylinder head 4. An intake port or an exhaust port 6 communicates with the combustion chamber 5 via an intake valve or an exhaust valve 7, as is well known. A valve stem 8 is slidably supported by a valve stem guide 9, which is provided in the cylinder head 4. Between a seat 10 formed on the cylinder head 4 and a spring retainer 11 fixed to the valve stem 8 is arranged a spring 12 which normally biases the valve stem 8 upwardly to urge the valve 7 to its seat 13. A rocker arm 14 connects the valve stem 8 to a push rod 15, with one end **14*a* of the rocker arm 14 engaging with a top 8*a* of the valve stem 8 and the other end 14*b* engaging with a top 15*a* of the push rod 15. An axial hole 16 is formed in the cylinder block 1, and a hydraulic valve lifter 17 is slidably fitted in the axial hole 16. An upper end of the hydraulic valve lifter is operably connected to a lower end 15*b* of the push rod 15, and a lower end of the hydraulic valve lifter 17 engages with a cam 18 which is rotatably connected to a crankshaft (not shown). The valve lifter 17 moves upward or downward according to the rotary movement of the cam 18, then the upward and downward movement of the valve lifter is transmitted to the valve stem 8 via the push rod 15 and the rocker arm 14. Thus, the valve 7 motion is controlled by the cam 18**.

Figure 2:
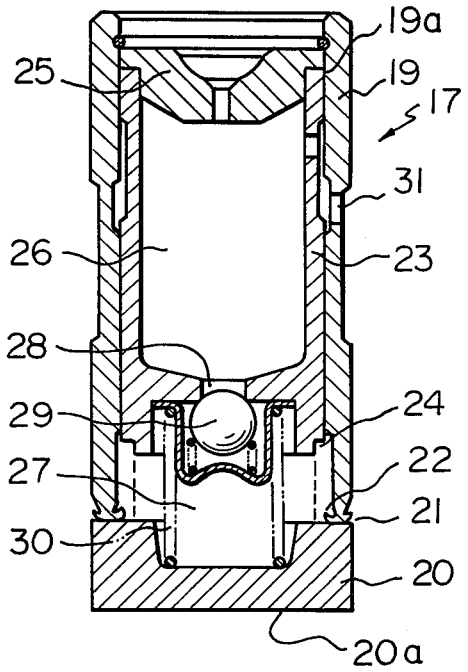
FIG. 2 shows a section of a hydraulic valve lifter, according to the invention.

In FIG. 2, the hydraulic valve lifter 17 is shown in more detail. The valve lifter 17 has a body which consists of a hollow cylindrical portion 19 and a lower end portion 20. A conventional lifter body has been formed as a unit by casting or joined brazing, as described hereinbefore. The lifter body, according to the invention, is joined by means of welding the hollow cylindrical body portion 19 and the lower end portion at a section represented by the numeral 21. As a result of welding, flash 22 projects annularly inside and outside the body. The inwardly projecting flash 22 remains in the recess of the hollow cylindrical body portion 19, while the outwardly projecting flash is easily removed.

A plunger 23 is accommodated in an axial hole **19*a* of the cylindrical body portion 19, which can move slidingly along an inner surface of the hollow portion in the longitudinal direction during engine operation. A lower peripheral wall 24 of the plunger 23** is cut out annularly, according to the invention, which is described hereinafter.

The other components of the hydraulic valve lifter 17 are described briefly, since they are well known to those skilled in the art. There are provided a cup element 25 which moves together with the plunger 23 and is connected to the above-mentioned push rod 15, a reservoir 26 which is defined inside the plunger 23 under the cup element 25, and a pressure chamber 27 defined inside the body 19 and 20 under the plunger 23. An oil passage 28 communicates the reservoir 26 with the pressure chamber 27, and a ball check valve 29 is provided to allow oil to flow one way only through the passage 28 from the reservoir 26 to the pressure chamber 27. A plunger return spring 30 biases the plunger 23 upwardly as viewed. Oil is fed from an inlet 31.

Figure 3:
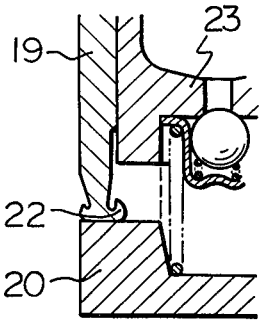
FIG. 3 shows a fragmental view of a hydraulic valve lifter for illustrating interference between a plunger and flash.

The valve lifter 17 moves upward or downward according to the movement of the cam 18. This valve lifter movement causes the plunger 23 to move slidably upward or downward, relative to the lifter body 19 and 20, in which the plunger 23 is shown in its upper position in FIG. 2. This plunger movement is limited to a small distance. However, the plunger 23 may be lowered gradually to a position where the lower end of the plunger 23 contacts the flash 22, for example, when the engine is stopped at a position where the valve 7 is open. FIG. 3 illustrates the fact that, in the absence of the cut-out in the lower wall 24 of the plunger 23, the inwardly projecting flash 22 will interfere with the lower end of the plunger 23 when it is lowered.

Figure 4:
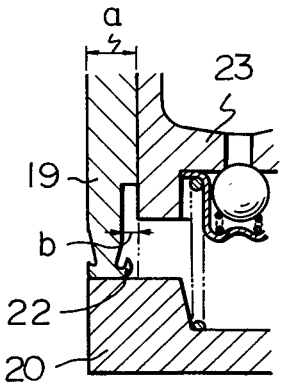
FIG. 4 shows a fragmental view of an example for preventing interference, in which the body wall must be made thick.

In order to avoid such an interference, a section of the inner surface of the cylindrical body may be removed so that it will not contact the outer surface of the plunger 23 at the section b, as shown in FIG. 4. However, this accompanied by an undesirable increase of the thickness a of the body wall. Otherwise, the inwardly projecting flash 22 should be removed. However, removing the flash 22 in the recess of the body is not an easy operation.

The fundamental object of the present invention is to solve the above problem. One of the functions of the plunger 23 is to pass the oil through the minimum clearance between the outer surface of the plunger 23 and the inner surface of the cylindrical body 19 when the hydraulic valve lifter 17 moves upward. This function is not lost if a section of the outer wall of the cylindrical plunger 23 is cut out annularly at its lowermost area, because of the remaining outer surface of the plunger effects the above function. The cut out portion is shown by the numeral 24 in FIG. 2, with a rectangular cross section.

The lower end portion 20 of the body is formed substantially flat in order to close the axial hole 19*a* of the hollow cylindrical portion 19; it provides only a seat for the spring 30 in the central region. Therefore, when the plunger 23 is lowered, the bottom of plunger engages with the flat surface of the lower end portion 20, without the cut out portion 24 contacting the inwardly projecting flash 23.

As stated hereinbefore, it is necessary that the lower end portion 20 engaging with the cam 18 be highly durable and wear resistant. For this purpose, it is desirable that the lower end portion 20 be made of a wear resistant material, such as an alloy cast iron, and that the hollow cylindrical portion 19 be made of a highly machinable material, such as a low carbon steel, with the two portions being subsequently joined by welding. In the welding process, it is not necessary to remove the inwardly projecting flash 22 perfectly because the plunger 23 is cut out during machining before the assembling step.

Figure 5:
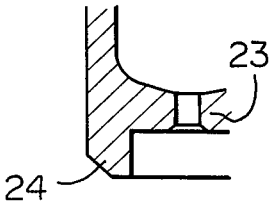
FIG. 5 shows a fragmental section of another embodiment of a hydraulic valve lifter.

FIG. 5 shows another embodiment of the invention, in which a triangular cross section is cut out from the bottom of the plunger 23 in order to prevent interference between the flash 22 and the plunger 23.

We claim:

1. A hydraulic valve lifter comprising a body including a hollow cylindrical portion having an axially extending hole and a lower end portion having an outer surface for contacting a cam and a flat surface facing said cylindrical portion, said end portion being welded to said cylindrical portion at said flat surface; and a plunger slidably mounted within said hole along an inner surface of said cylindrical portion; said plunger having a bottom for engaging said flat surface with a peripheral annular cut-out in said bottom facing said end portion to avoid contact with inwardly projecting flash on said cylindrical portion caused by welding of said cylindrical portion to said end portion.

2. A valve lifter according to claim 1, wherein said cylindrical portion and said end portion are welded by means of resistance welding.

3. A valve lifter according to claim 1, wherein said cylindrical portion and said end portion are welded by means of projection welding.

4. A valve lifter according to claim 1, wherein a cross section of said annular cut-out of said plunger is of a rectangular shape.

5. A valve lifter according to claim 1, wherein a cross section of said annular cut-out of said plunger is of a triangular shape.

* * * * *